US006345691B1

(12) United States Patent
Ruiz

(10) Patent No.: US 6,345,691 B1
(45) Date of Patent: Feb. 12, 2002

(54) LADDER LATCH SYSTEM

(75) Inventor: Hans Ruiz, Gardena, CA (US)

(73) Assignee: Windline Inc., Gardena, CA (US)

( * ) Notice: Subject to any disclaimer, the term of this patent is extended or adjusted under 35 U.S.C. 154(b) by 0 days.

(21) Appl. No.: 09/680,003

(22) Filed: Oct. 5, 2000

(51) Int. Cl.[7] ..... E06C 1/00; E06C 5/00; E04G 3/00

(52) U.S. Cl. ..... 182/195; 182/127; 182/91; 182/88

(58) Field of Search ..... 182/127, 91, 88, 182/97, 195; 280/163, 165, 166

(56) References Cited

U.S. PATENT DOCUMENTS 3,008,533 A * 11/1961 Haberle ..... 182/88
3,451,506 A * 6/1969 Neal ..... 182/195
3,653,463 A * 4/1972 Neal et al. ..... 182/195
3,997,026 A * 12/1976 Riehlmann ..... 182/96
4,119,177 A * 10/1978 Andersson ..... 182/195
4,139,078 A * 2/1979 Keller ..... 182/88
4,860,854 A * 8/1989 Lodholz, Jr. ..... 182/88
4,989,692 A * 2/1991 Min ..... 182/195 X
5,205,603 A * 4/1993 Burdette, Jr. ..... 182/195 X
5,495,915 A * 3/1996 Weston et al. ..... 182/195
5,660,405 A * 8/1997 Campbell ..... 182/88 X
5,687,813 A * 11/1997 Bensch ..... 182/127
5,697,470 A * 12/1997 Carle ..... 182/88
5,738,186 A * 4/1998 Jones ..... 182/195
5,743,355 A * 4/1998 McDonnell et al. ..... 182/195
5,806,627 A * 9/1998 Wilson ..... 182/127
5,941,342 A * 8/1999 Lee ..... 182/127 X
6,058,875 A * 5/2000 Krish, Jr. ..... 182/97 X
6,170,843 B1 * 1/2001 Maxwell et al. ..... 182/91 X

* cited by examiner

*Primary Examiner*—Daniel P. Stodola
*Assistant Examiner*—Hugh B. Thompson

(57) ABSTRACT

A Ladder Latch System for securing telescoping ladders in the retracted position is described. The latching system is a component of a telescoping ladder system, which has as its main components a plurality of telescoping ladder legs, a ladder-mounting bracket, and a latch-releasing mechanism. The latching system is mounted to the ladder-mounting bracket and secures the telescoping ladder legs, which are in turn released by the latch-release mechanism.

38 Claims, 10 Drawing Sheets

LADDER LATCH SYSTEM

BACKGROUND—FIELD OF THE INVENTION

This invention relates to ladder latch systems, specifically those used to secure telescoping ladders used in a marine environment.

BACKGROUND—DESCRIPTION OF PRIOR ART

In a marine environment, ladders are components that are essential in order for people to board and exit boats safely and easily. These ladders, once they have been used for either boarding or leaving the boat, need to be removed from the side of the boat once it is under way. This is necessary to prevent drag, or to prevent the ladder from catching on any objects. It is also necessary to prevent damage to the ladder itself while the boat is being docked. This necessity has led to the widespread use of telescoping ladders on most recreational and other marine craft. Adhered to the boat like other ladders, telescoping ladders, like their name implies, can be easily and safely retracted, just like a telescope, back on board the boat once the craft is under way or after they have served their purpose. When they are needed again, they are simply extended out over the side of the boat. In its retracted position, the ladder rests on the deck on top of a platform or slides underneath and rests under it.

A typical telescoping ladder has three to four steps, and in the retracted position these steps rest closely against each other but have nothing preventing them from being extended accidentally. An accidental extension like this could take place while the ship rolls during heavy seas, or while the ladder itself is being transported. Such an accidental extension could result in injury to a passenger or damage to the boat itself Therefore the need has arisen for some type of latch, or fastener, to secure the ladder's steps while the ladder is retracted and not in use. And since the space on water-going vessels is limited, any telescoping ladders used on such vessels need to be compact and space efficient. And therefore, any fastener that might be a component of this type of ladder also needs to be small and compact. In addition, since this environment involves water, any fastener used here also needs to be sufficiently resistant to and unexposed to the corrosive effects of water. One such fastener already developed is one used to secure a collapsible fire ladder in U.S. Pat. No. 5,022,491 to Gill, Jun. 11, 1991. But this is for a collapsible ladder used as an escape ladder in case of an emergency, and is too large and bulky to be used on a telescoping ladder in a marine environment. Also, this fastener is exposed to the elements, leaving it vulnerable to rust and corrosion.

Another invention utilizing the concept of a retractable or telescoping ladder and latch, is presented in U.S. Pat. No. 5,743,355 to McDonnell et al, Jul. 31, 1996. This device has all the conveniences of a telescoping ladder, such as easy storage and compactness. However, the latch it utilizes is an overly complex device that requires manual manipulation initially to be set, and then further manipulation through levers to be locked into place. The levers themselves extend from the uppermost rung of the ladder, and as a result could interfere with securing a safe grip on that rung.

Despite their latching system's shortcomings, these two retractable ladder systems are better than most telescoping ladder systems which do not have latches or any other means to secure them when they are in a retracted position.

Some important objects of the invention presented here are to provide a latch system for a telescoping ladder that is lightweight, easy to use, strong, inconspicuous, and space efficient. An additional object is to provide a latch system that is resistant to the effects of the elements such as rust and corrosion.

OBJECTS AND ADVANTAGES

Most of the few ladder latch systems that exist are either too cumbersome or too complex to be used in an easy, reliable, effective, and safe manner. The use of telescoping ladders brings with it the danger of accidental extension, which could cause injury to people or damage to property. Consequently, the use of these ladders demands the accompanying use of a latch system to safely secure the ladder when it isn't being used. The ladder latch system presented here provides a strong, lightweight, easy-to-use system for safely and effectively securing telescoping ladders when they are in a retracted position.

Accordingly, several objects and advantages of this invention are:

1. The ladder latch system requires little space whether in use or not. It does this by being positioned along the ladder-mounting bracket and by being aligned with the innermost leg of the telescoping ladder. To secure the telescoping legs, the legs are pushed in the direction of and over the latch. The latch, now inside the ladder legs, secures the telescoping legs by hooking onto a catch that is a part of the innermost ladder leg. In this way the latch secures the ladder legs while remaining out of sight. And it does this while requiring only a minimal amount of external space.
2. The ladder latch system is easy to operate. To engage the latch, all that needs to be done is to slide the ladder back into the retracted position. Whenever this happens, the latch automatically secures the ladder legs by catching on the catch inside the innermost ladder leg. To release the latch, a knob is pressed at the base of the ladder legs which in turn presses on a rod that pushes the latch away from the catch. This disengages the latch in a quick and uncomplicated manner.
3. The system is simple in design and durable. Its components consist of a spacer, a latch, some screws, some nuts, a knob, a spring, a rod, and a pin. The catch that the latch engages when the system is in use is the half circle portion of the end of the innermost ladder leg. This catch has no moving parts or complex levers. And since the innermost ladder leg is usually made of one molded, metal piece, the catch itself is made of metal and is therefore strong and highly durable. The release mechanism is also simple in design. It is comprised of a rod inside the innermost ladder leg that is attached to a knob utilizing a spring action to push the rod forward. The spring returns the entire release mechanism to its normal position after the knob has ceased being depressed. The knob containing the spring is anchored to the innermost ladder leg with a pin. Like the ladder latch mechanism that secures the ladder legs, it has no complex levers or moving parts that are delicate enough to break down easily or too difficult to repair.

BRIEF DESCRIPTION OF DRAWINGS

FIG. 1 is a side view showing a typical telescoping ladder in an extended position that a ladder latching mechanism would be used on.

REFERENCE NUMERALS FOR FIGS. 1–8

Figure 2:
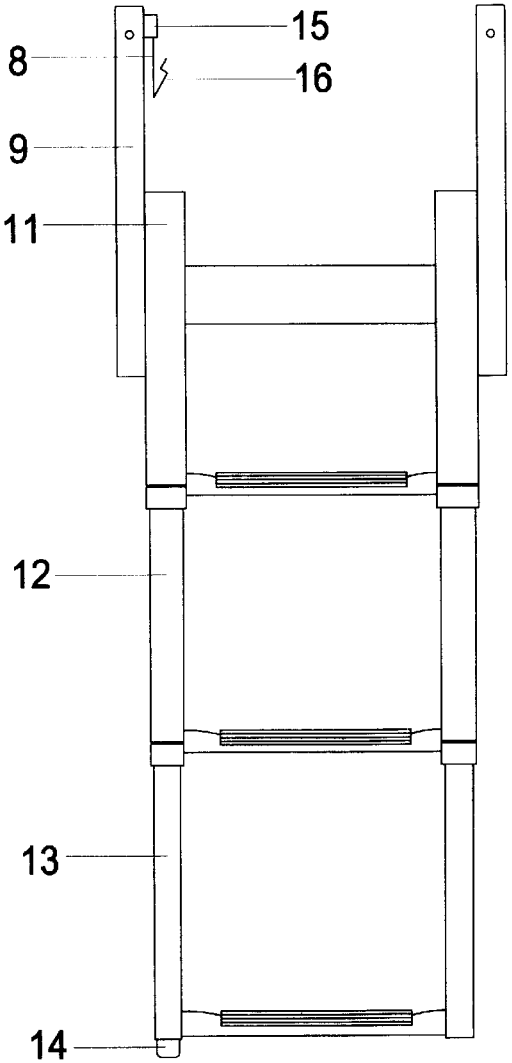
FIG. 2 is a front view of the ladder again in an extended position.
Figure 1:
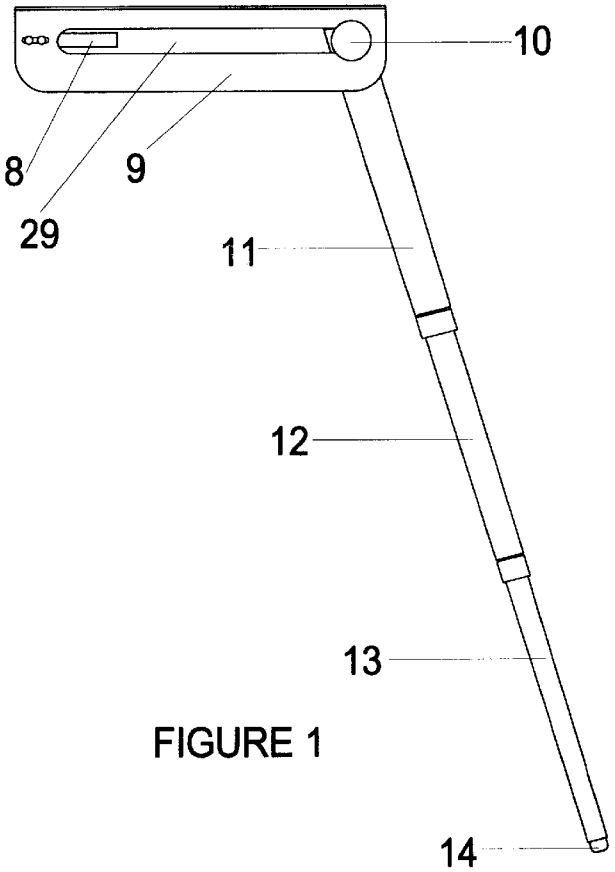
Figure 3:
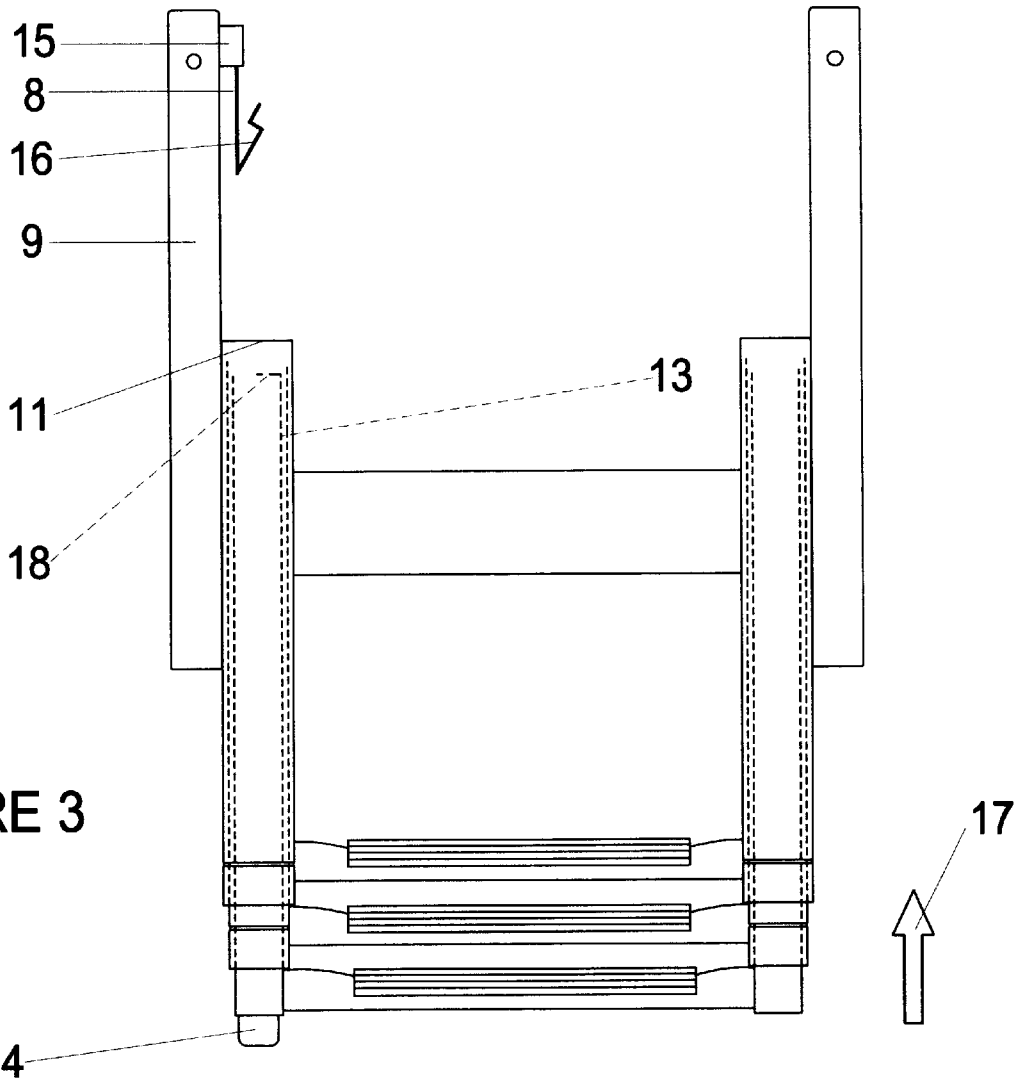
FIG. 3 is another front view showing the ladder in the process of being retracted. The arrow shows the direction in which the telescoping ladder legs are retracted. Also shown are interior views of the telescoping ladder legs.
Figure 4:
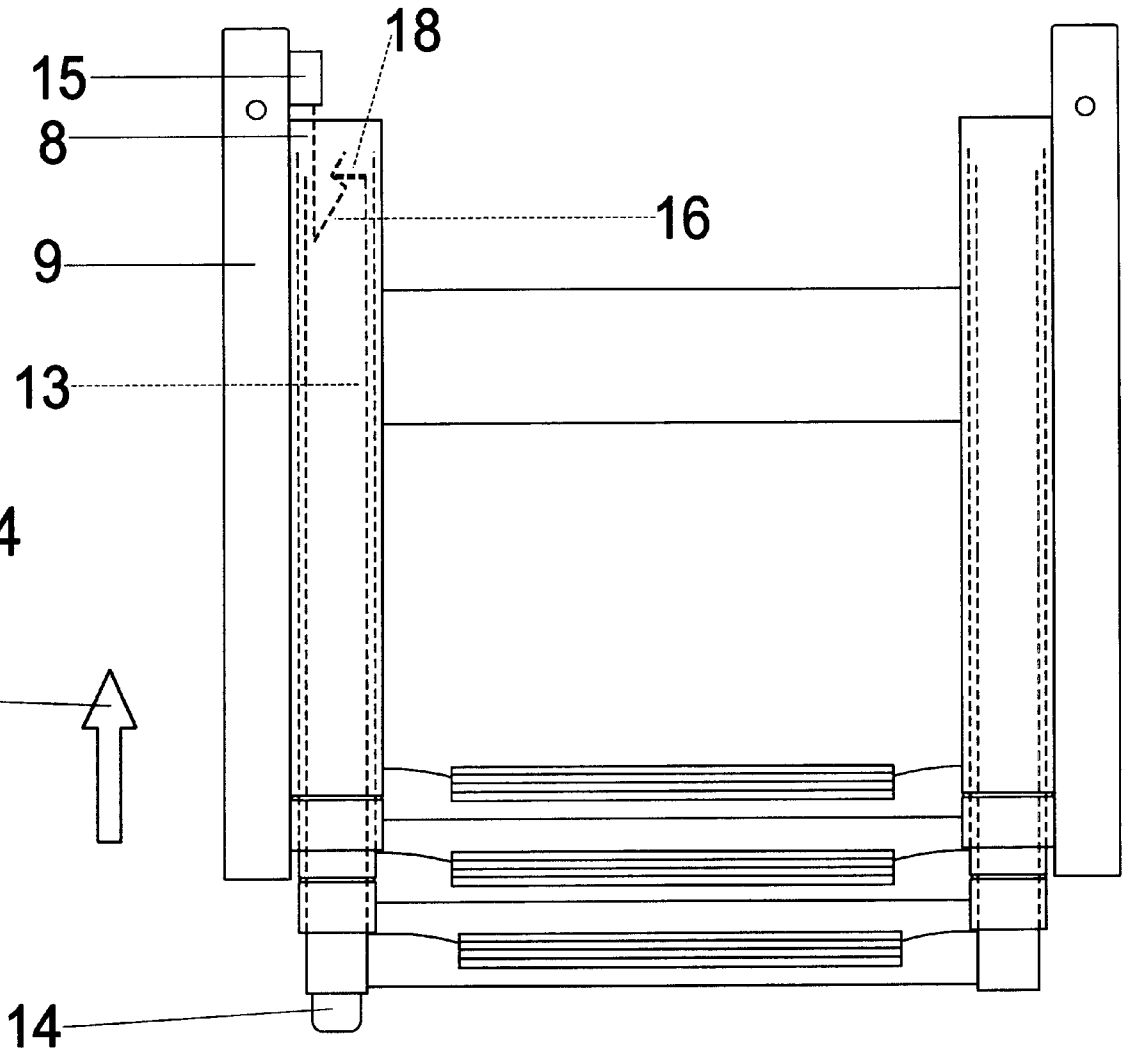
FIG. 4 is an additional front view showing the ladder in a fully retracted position and secured by the metal latch.
Figure 4A:
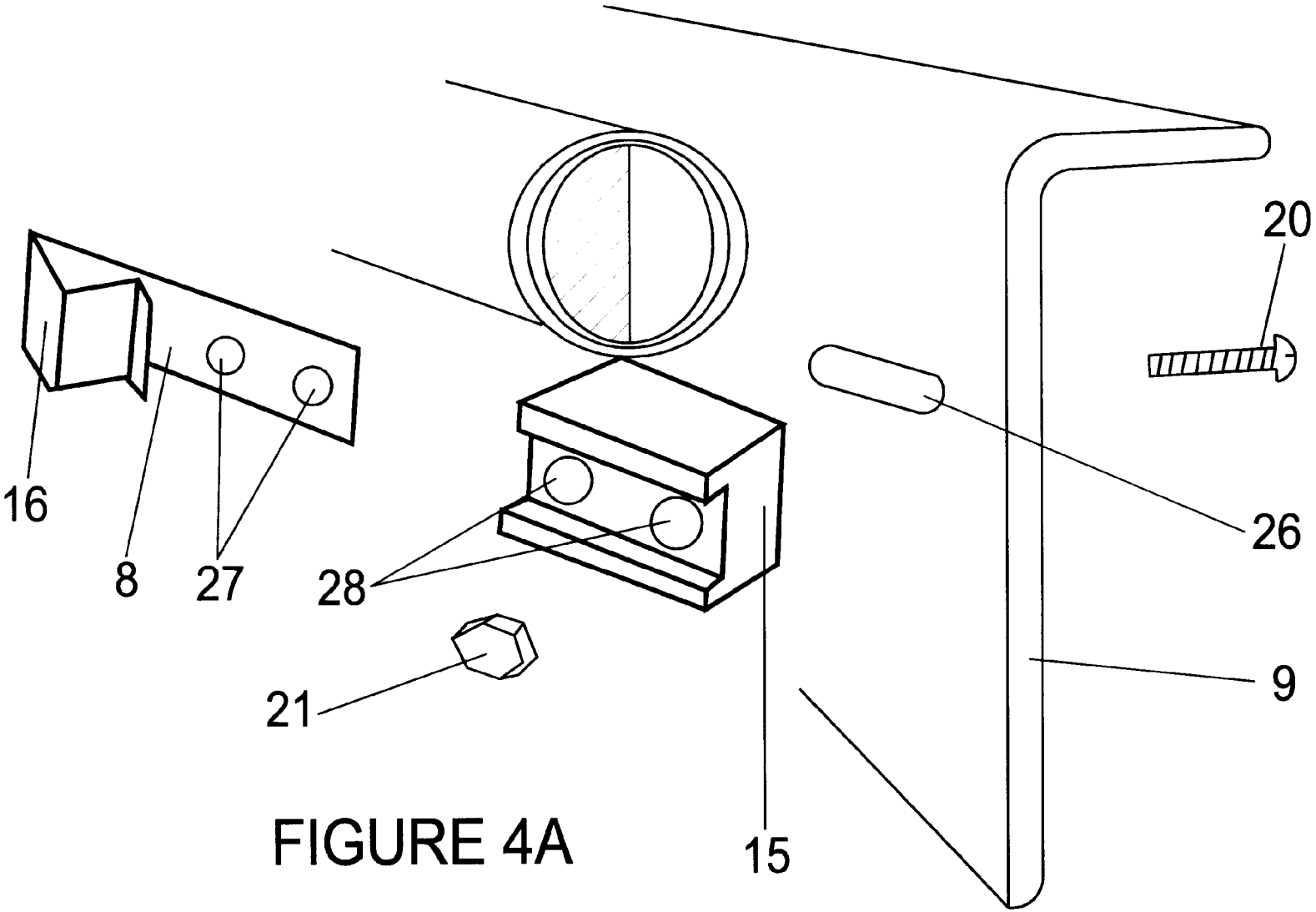
FIG. 4A is an exploded view showing the primary components of the latch system before they are fastened to the ladder-mounting bracket.
Figure 4B:
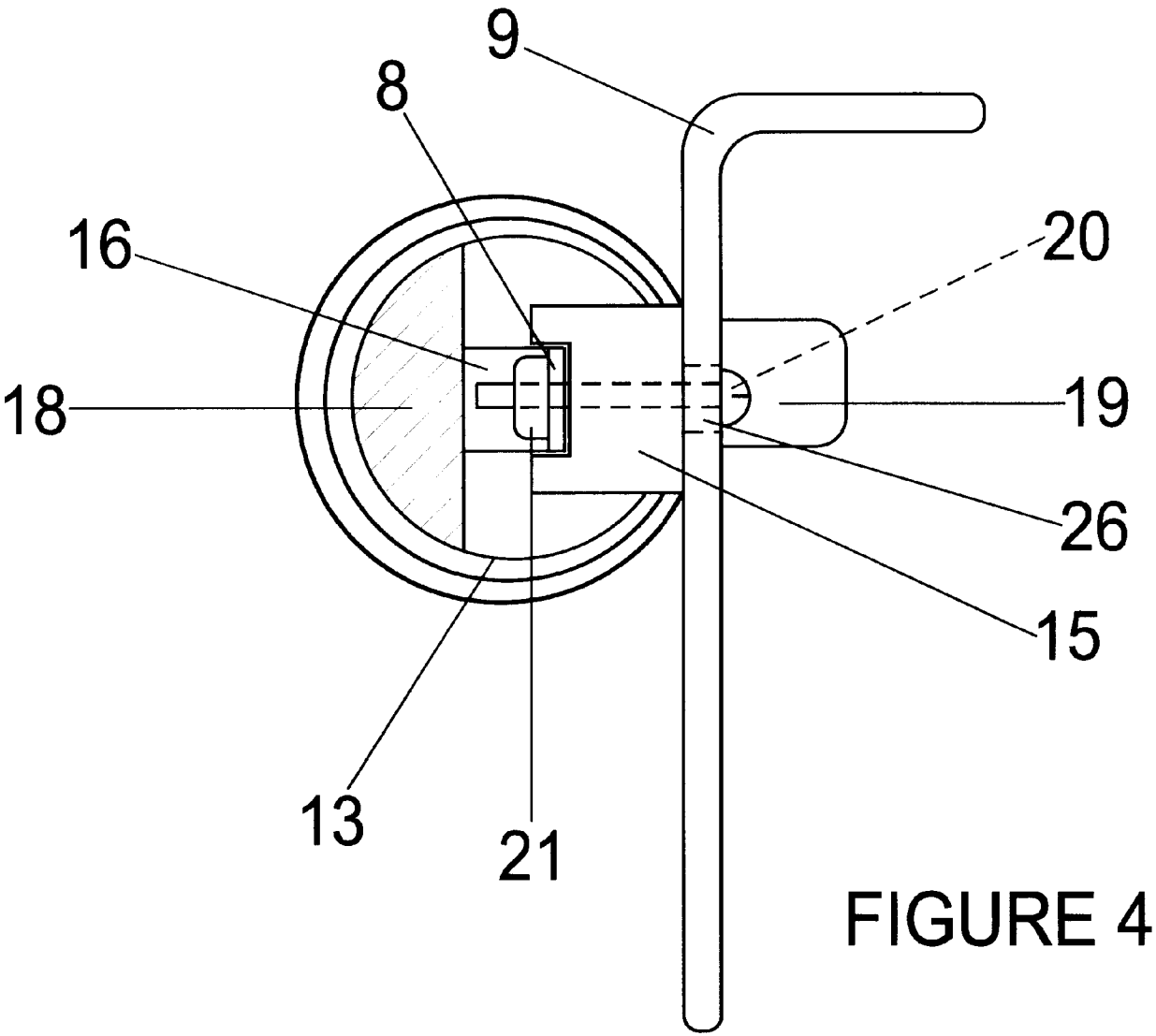
FIG. 4B is a cut-away, head-on view showing the primary components of the latch system fastened to the ladder-mounting bracket.
Figure 5:
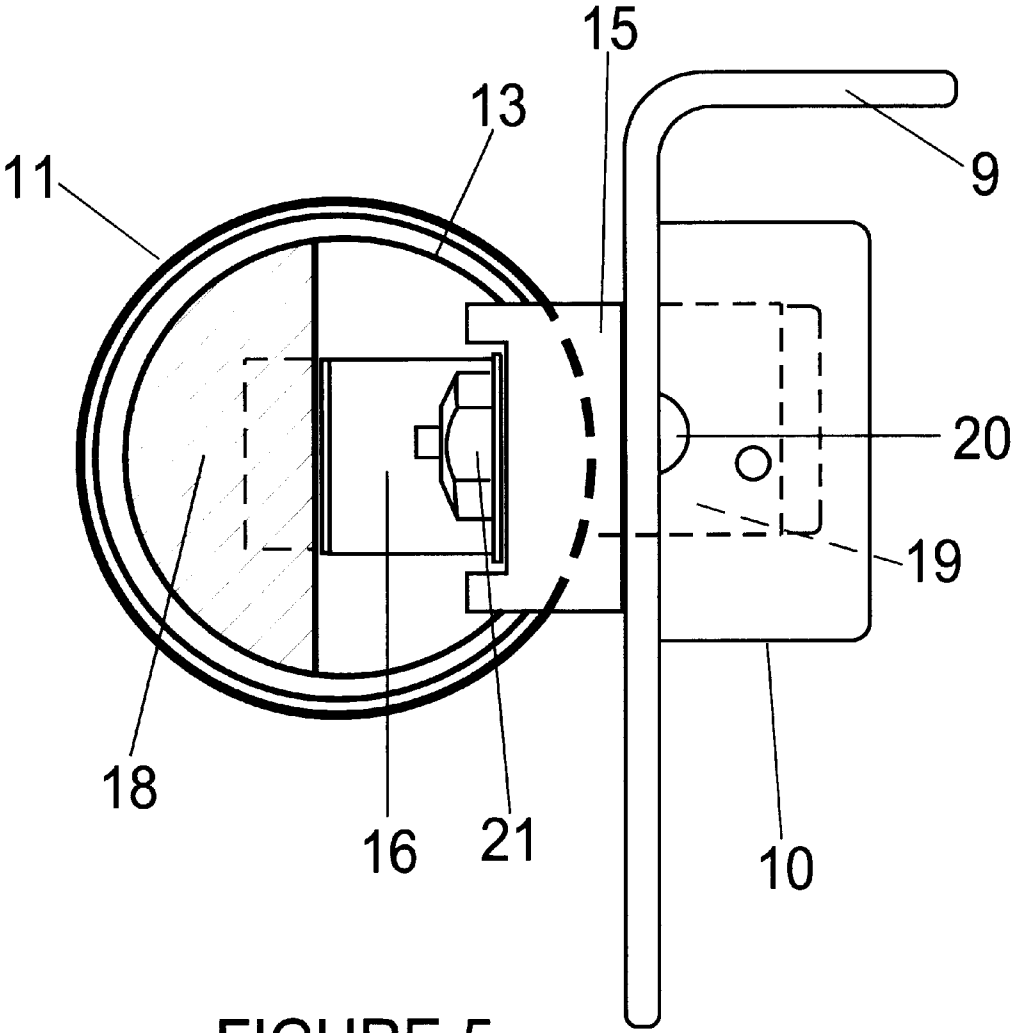
FIG. 5 is a straight-on, close-up view of the latch clasping behind the catch at the end of the innermost telescoping ladder leg.

FIG. 1
8.—latch
9.—ladder-mounting bracket
10.—retaining collar
11.—outermost telescoping ladder leg
12.—middle telescoping ladder leg
13.—innermost telescoping ladder leg
14.—latch release knob
29.—ladder-mounting bracket slot FIG. 2
8.—latch
9.—ladder-mounting bracket
11.—outermost telescoping ladder leg
12.—middle telescoping ladder leg
13.—innermost telescoping ladder leg
14.—latch release knob
15.—spacer
16.—bent portion of latch FIG. 3
8.—latch
9.—ladder-mounting bracket
11.—outermost telescoping ladder leg
13.—innermost telescoping ladder leg
14.—latch release knob
15.—spacer
16.—bent portion of latch
17.—arrow showing direction of movement
18.—catch FIG. 4
8.—latch
9.—ladder-mounting bracket
13.—innermost telescoping ladder leg
14.—latch release knob
15.—spacer
16.—bent portion of latch
17.—arrow showing direction of movement
18.—catch FIG. 4A
8.—latch
9.—ladder-mounting bracket
15.—spacer
16.—bent portion of latch
20.—screw(s)
21.—nut(s)
26.—oblong hole in ladder-mounting bracket
27.—holes in latch
28.—holes in spacer FIG. 4B
8.—latch
9.—ladder-mounting bracket
13.—innermost telescoping ladder leg
15.—spacer
16.—bent portion of latch
18.—catch
19.—stop arm
20.—screw(s)
21.—nut(s)
26.—oblong hole in ladder-mounting bracket FIG. 5
9.—ladder-mounting bracket
10.—retaining collar
11.—outermost telescoping ladder leg
13.—innermost telescoping ladder leg
15.—spacer
16.—bent portion of latch
18.—catch
19.—stop arm
20.—screw(s)
21.—nut(s)

Figure 5A:
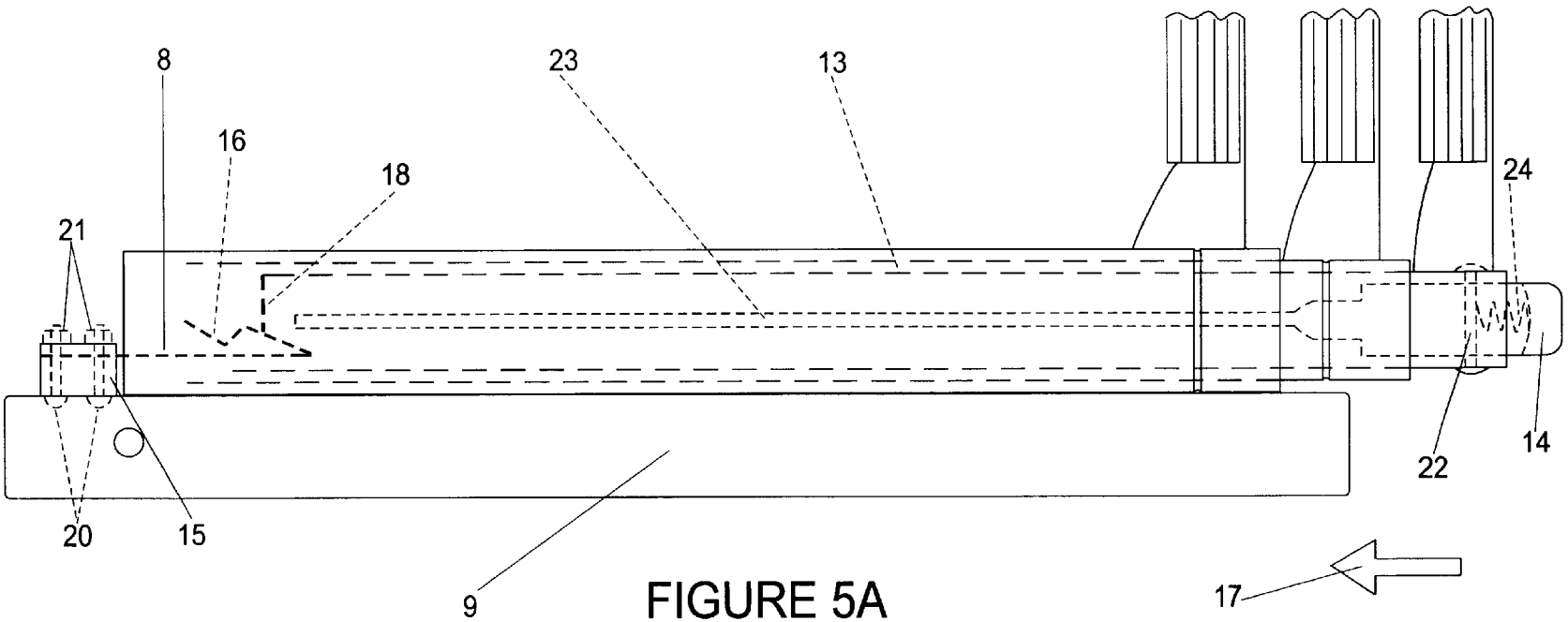
FIG. 5A is a top view showing the catch sliding over and depressing the bent portion of the latch as the ladder legs are retracted into the secured position.
Figure 5B:
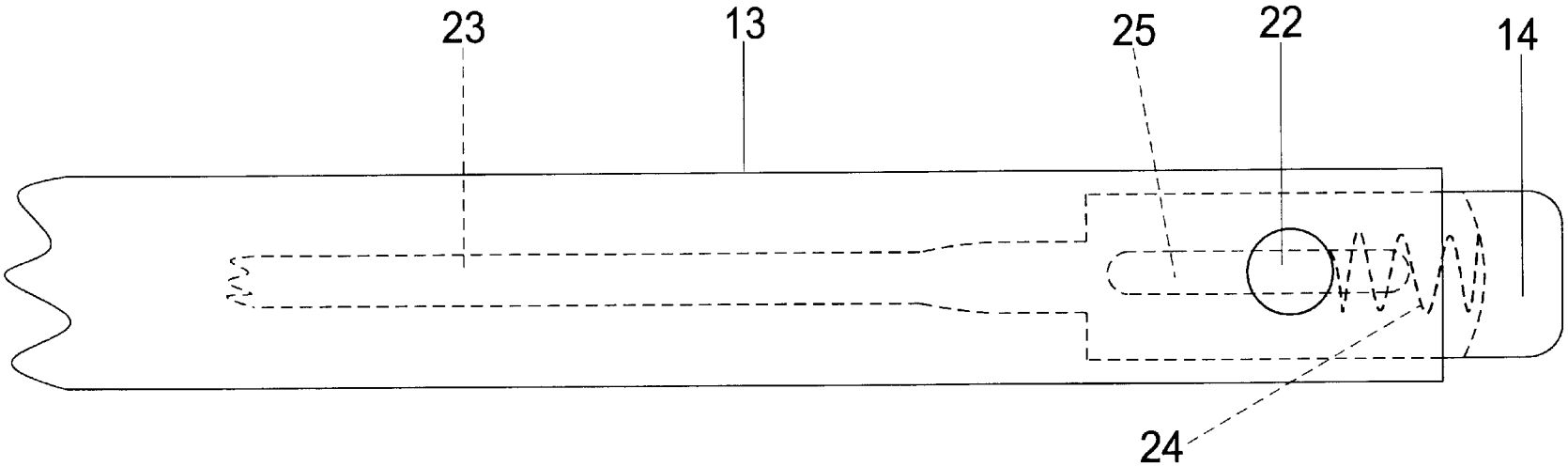
FIG. 5B is a close-up, side view of the area at the base of the innermost telescoping ladder leg emphasizing the latch release knob and the latch release knob aperture.
Figure 6:
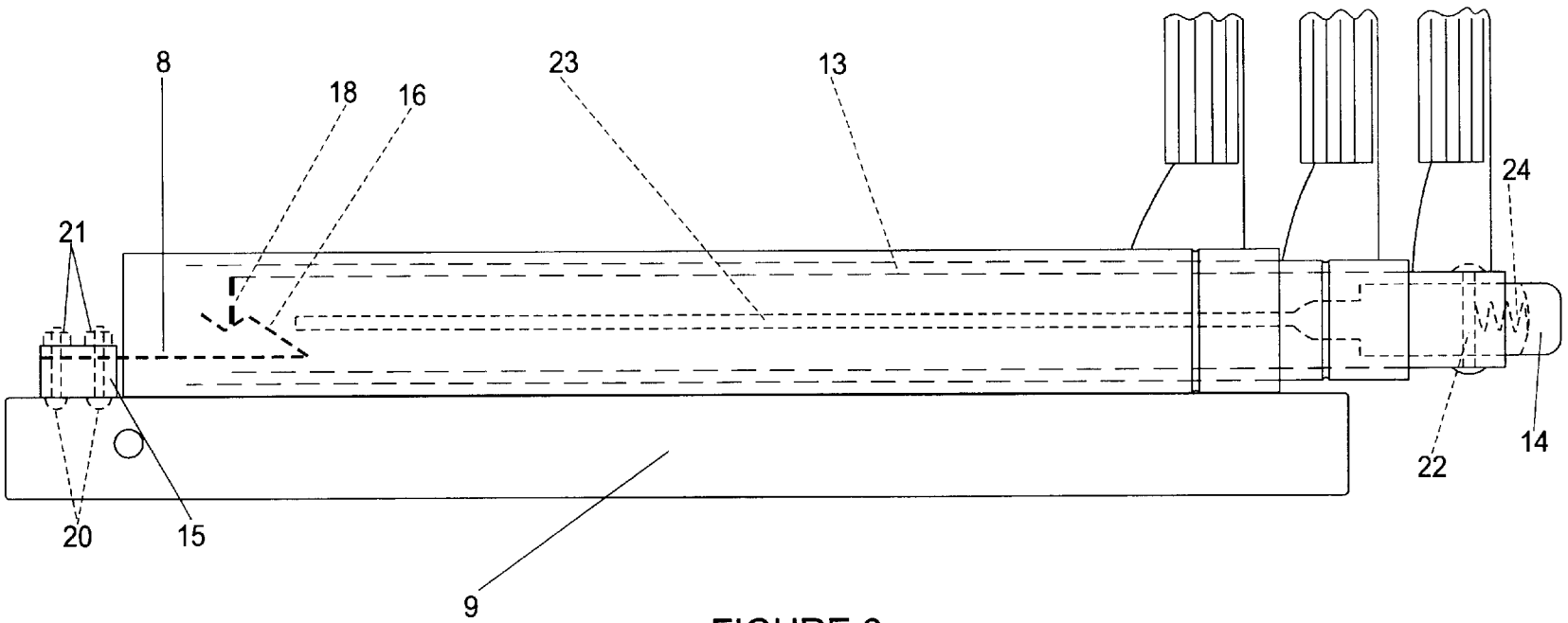
FIG. 6 is a top view showing the latch engaging the catch and securing the telescoping ladder legs in the retracted position.
Figure 7:
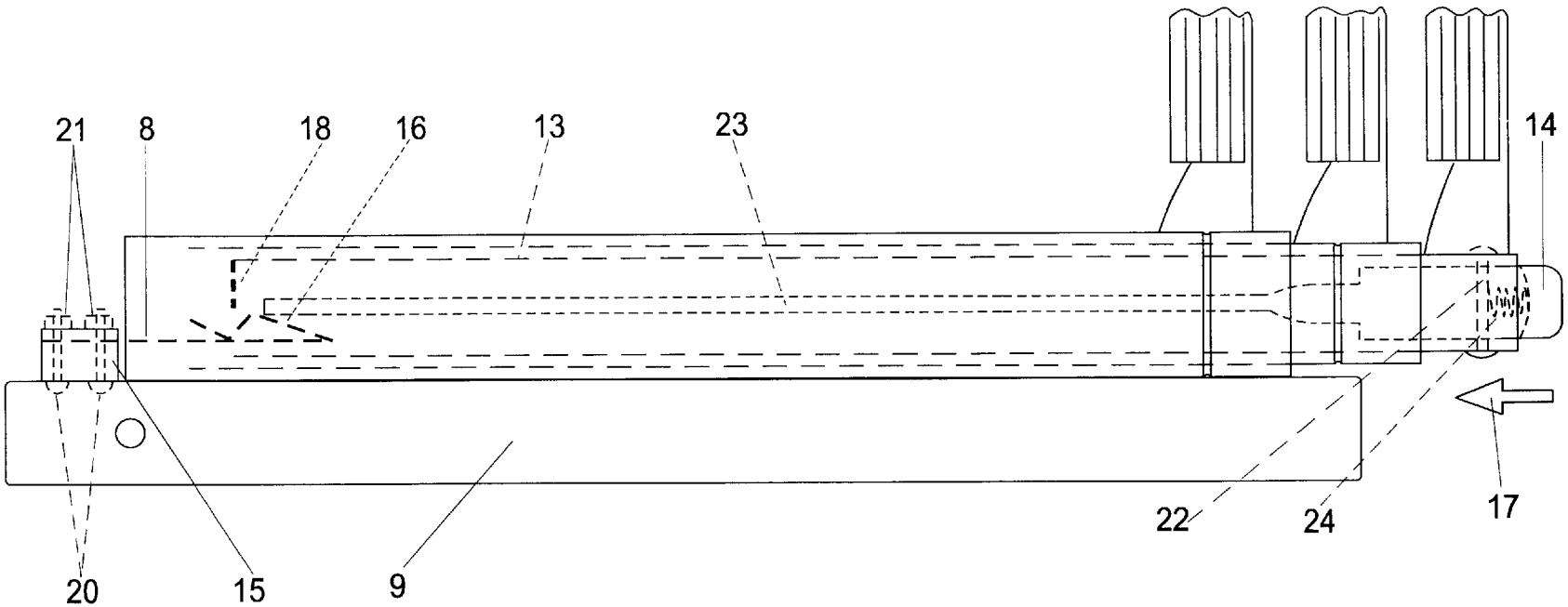
FIG. 7 is a top view showing the latch release rod depressing the latch and disengaging the ladder latch system from the retracted telescoping ladder legs. The arrow shows the direction in which the rod moves after force is exerted on the latch release knob.

FIG. 5A
8.—latch
9.—ladder-mounting bracket
13.—innermost telescoping ladder leg
14.—latch release knob
15.—spacer
16.—bent portion of latch
17.—arrow showing direction of movement of telescoping ladder legs
18.—catch
20.—screw(s)
21.—nut(s)
22.—pin
23.—latch release rod
24.—spring FIG. 5B
13.—innermost telescoping ladder leg
14.—latch release knob
22.—pin
23.—latch release rod
24.—spring
25.—latch release knob aperture FIG. 6
8.—latch
9.—ladder-mounting bracket
13.—innermost telescoping ladder leg
14.—latch release knob
15.—spacer
16.—bent portion of latch
18.—catch
20.—screw(s)
21.—nut(s)
22.—pin
23.—latch release rod
24.—spring FIG. 7
8.—latch
9.—ladder-mounting bracket
13.—innermost telescoping ladder leg
14.—latch release knob
15.—spacer
16.—bent portion of latch
17.—arrow showing direction of movement of telescoping ladder legs
18.—catch
20.—screw(s)
21.—nut(s)
22.—pin
23.—latch release rod
24.—spring

SUMMARY OF THE INVENTION

In accordance with the invention, this ladder latch system for securing telescoping ladders in the retracted position is comprised of a latch, a spacer, screws, nuts, a catch, a spring, a knob, a pin, and a rod. The spacer has a groove on one side and at least two holes. The latch is bent at an acute angle at one end and has at least two holes in its straight end that is opposite the bent end. The straight end of the latch is slid into the groove of the spacer until its holes are aligned with those of the spacer. The latch is inserted so that the bent portion of the latch is on the side of the straight portion of the latch that is facing towards the center of the ladder. The spacer, along with the latch slid into position, is positioned on the inner side of the ladder-mounting bracket in front of the telescoping ladder legs and over an oblong hole in the ladder-mounting bracket. It is aligned so that its holes, and those of the latch, are lined up with the oblong hole in the ladder-mounting bracket. To fasten the spacer and latch to the ladder-mounting bracket, screws are inserted through the oblong hole from the side opposite the side where the spacer and latch are and into and through both the spacer and the latch. These screws are then secured with nuts.

To secure the telescoping ladder in a retracted position, the ladder legs are slid down into their retracted position until the catch inside the innermost ladder leg is snared by the latch attached to the ladder-mounting bracket. To release the latch, a knob connected to a long rod at the opposite end of the innermost ladder leg is pressed which in turn presses upon the long rod. The rod pushes against the bent part of the latch, depressing it until it is clear of the catch. This, combined with a pulling motion on the ladder legs, brings the ladder into an extended position again. A spring inside the knob returns the knob and rod to their former positions.

DETAILED DESCRIPTION OF INVENTION—FIGS. 1–5, 5B, AND 6

Referring in greater detail to the drawings, FIG. 1 is a side view that shows a typical telescoping ladder in the extended position. The ladder is comprised of a ladder-mounting bracket 9 to which is attached a latch 8. Secured to ladder-mounting bracket 9 by a retaining collar 10 is an outermost telescoping ladder leg 11. Retaining collar 10 occupies a ladder-mounting bracket slot 29 and can be slid up or down the length of it. Proceeding down from outermost telescoping ladder leg 11 is a middle telescoping ladder leg 12. And proceeding down from middle telescoping ladder leg 12 is an innermost telescoping ladder leg 13. At the end of innermost telescoping ladder leg 13 is a latch release knob 14.

FIG. 2 is a front view that again shows the ladder in its fully extended position. Also shown are some of the components of this invention, such as latch 8 attached to a spacer 15, and a bent portion of latch 16. Spacer 15 is attached to ladder-mounting bracket 9, which is in turn connected to outermost telescoping ladder leg 11. Extending from outermost telescoping ladder leg 11 is middle telescoping ladder leg 12. And extending from middle telescoping ladder leg 12 is innermost telescoping ladder leg 13. Protruding from innermost telescoping ladder leg 13 is latch release knob 14.

FIG. 3 is a front view showing the ladder in a partially retracted position. FIG. 3 also shows more components of this invention. As with the previous figures, latch release knob 14, spacer 15, latch 8, bent portion of latch 16, and ladder-mounting bracket 9 attached to outermost telescoping ladder leg 11 are shown. Welded to the end of innermost telescoping ladder leg 13 is metal catch 18. An arrow 17 shows the direction in which the ladder legs are retracted.

Fig .4 is a front view showing the ladder in a fully retracted position with the latch engaged. Attached to ladder-mounting bracket 9 is spacer 15. Extending from spacer 15 is latch 8, and extending from latch 8 is a bent portion of latch 16. A catch 18, at the end of innermost telescoping ladder leg 13, is secured by bent portion of latch 16. An arrow 17 shows the direction in which the ladder legs are retracted. Also shown is latch release knob 14.

FIG. 4A is an exploded view showing several main components of this invention before they are fastened to the ladder-mounting bracket. Latch 8, along with bent portion of latch 16, is inserted into groove of spacer 15 straight portion first so that a plurality of holes 28 in spacer line up with a plurality of holes 27 in the latch. The spacer, with the latch now in its groove, is placed over an oblong hole 26 in ladder-mounting bracket 9. To fasten spacer 15 and latch 8 to ladder-mounting bracket 9, a screw(s) 20 is inserted through opposite side of ladder-mounting bracket 9 until passing through holes in spacer and latch. Screw(s) 20 is then fastened by a nut(s) 21.

FIG. 4B shows the main components of this invention, as shown in FIG. 4A, attached to the ladder-mounting bracket 9. Spacer 15 and latch 8 are placed in front of oblong hole in ladder-mounting bracket 26 so their holes line up with it. Screw(s) 20, inserted through oblong hole 26 in ladder-mounting bracket 9, passes through the holes in the spacer and the latch until emerging on the other side. There it is secured by nut(s) 21. The latch is now in a position where it can engage catch 18 at the end of innermost telescoping ladder leg 13.

FIG. 5 is a close-up, head-on view showing ladder-mounting bracket 9 with attached spacer 15. Also shown is outermost ladder leg 11 fastened to a stop arm 19, and stop arm 19 is in turn encompassed by retaining collar 10. Spacer 15 is fastened to ladder-mounting bracket 9 by screw 20 and nut 21. Bent portion of latch 16 is clasped behind catch 18, which is at the end of innermost telescoping ladder leg 13.

FIG. 5B is a side view emphasizing a latch release knob aperture 25 running through the center of latch release knob 14 with open sides on both sides of the knob. It is through this aperture that a pin 22 runs and anchors latch release knob 14 to innermost telescoping ladder leg 13. It does this by bolting at both of its ends to walls of innermost telescoping ladder leg 13. And it is this aperture that allows latch release knob 14 to slide back and forth as it is depressed when used to disengage the latch.

FIG. 6 is a top view showing the latch system in its engaged position. Bent portion of latch 16 is caught by catch 18, which is at the end of innermost telescoping ladder leg 13. Latch 8 is attached to spacer 15, which is fastened to ladder-mounting bracket 9 by screws 20 and nuts 21. Also shown are additional components of the system, such as a latch release rod 23 connected to latch release knob 14, and spring a 24 braced against pin 22.

From the description provided above, it can be seen that many advantages of this ladder latching system become evident:

(a) It is small in size and does not occupy a lot of space.

(b) Since it is small in size, it is also lightweight and therefore does not add to the weight of any telescoping ladder system.

(c) The latch system is simple to operate. To engage the latch, all that is required is sliding the legs of the ladder back into a retracted position. Every time this is done, the latch locks onto the catch inside the innermost telescoping ladder leg and secures all the ladder legs. Releasing the latch involves pressing a latch release knob at the opposite end of the innermost telescoping ladder leg. The latch release knob is connected to a latch release rod, and pressing upon it pushes the latch release rod forward. As it presses forward, the latch release rod presses against the bent portion of the latch, depressing it until it is clear of the catch. This, combined with a pulling motion on the other end in the opposite direction, disengages the latch and frees the telescoping ladder legs so they can be extended again.

OPERATION OF INVENTION—FIGS. 5a AND 7

In FIG. 5A, as the telescoping ladder legs are pushed in the direction of arrow 17 towards bent portion of latch 16, catch 18 at the end of innermost telescoping ladder leg 13 pushes against bent portion of latch 16. As catch 18 pushes against bent portion of latch 16, it depresses it and continues sliding over and against it.

Referring back to FIG. 6, catch 18, at the end of innermost telescoping ladder leg 13, is now firmly clasped by bent portion of latch 16. Since the ladder legs are telescoping, they cannot be extended unless innermost telescoping ladder leg 13 is extended. In this way, by clasping bent portion of latch 16, catch 18 at the end of innermost telescoping ladder leg 13 keeps all the legs locked in the retracted position.

In FIG. 7, the latch system is disengaged when a force is exerted upon latch release knob 14. As the knob is pushed in the direction indicated by arrow 17, spring 24 braced against pin 22 compresses, ensuring that latch release rod 23 and latch release knob 14 return to their former positions after being depressed. As the rod moves forward, it depresses bent portion of latch 16 until catch 18 is clear of bent portion of latch 16. Combined with a pulling motion in the direction opposite of that indicated by arrow 17, the ladder legs are disengaged from the latch system and can now be extended.

Conclusion, Ramifications and Scope of Invention

After reviewing the above information, the reader will be able to see that the ladder latching system discussed here provides a vast improvement over the few latch systems that already exist in this field. It is simple in design and therefore easy to manufacture. And since it is attached to the ladder-mounting bracket and aligned with the telescoping ladder legs, it does not utilize a lot of additional space or get in the way of gripping the ladder rungs. In addition to these advantages, other advantages of this ladder latch system are:

It is light in weight. Telescoping ladders used in marine environments need to keep their weight to a minimum in order to be easily handled and stored. This latch system, being as light as it is, helps these ladders maintain their lightweight status.

It is small and compact, and as a result does not take up excessive room as part of a telescoping ladder assembly. This is important because the fewer the number of protruding mechanisms on any apparatus, in this example a telescoping ladder, the lower the potential for accidents such as fingers getting jammed or cut, or entanglement with other moving parts or objects.

It is easy to operate. To engage the latch system, all that one needs to do is slide the telescoping ladder legs back into a retracted position. Whenever this is done, the innermost telescoping ladder leg slides over the latch and catches it on its catch. This secures the ladder in the retracted position. To disengage, a latch release knob at the opposite end of the innermost telescoping ladder leg is pressed which in turn presses upon a latch release rod inside the innermost telescoping ladder leg. The latch release rod depresses the latch clear of and away from the catch. This, combined with a pulling motion in the opposite direction, releases the latch mechanism and pulls the telescoping ladder legs free of the latch.

Its composition and mechanism of action are simple, and are not excessively complex with a lot of moving parts that may wear out. The mechanism is comprised of three main components: a spacer and a latch joined by screws and nuts, a catch, and a release mechanism comprised of a latch release knob, a spring, a pin, and a latch release rod connected to the knob which runs through the interior of the innermost ladder leg. The only movements that occur are in the flexible bent portion of the latch clasping onto the catch, the movement of the spring and the latch release rod as the latch release knob is pushed, and the latch being depressed and released by the latch release rod. And even these movements consist of only a minimal distance in either direction.

While the above description contains many details and specifications, these should not be considered a limitation on the scope of this invention, but rather as a description of one preferred embodiment of this mechanism. Several other variations are possible. For example, this ladder latching system could be made with differently shaped spacers, or spacers made of a variety of materials, such as plastic, hardened rubber, polyurethane resin, etc. This latching system could be constructed with latches having different shapes, such as square, triangular, or rectangular. The latch could be made of any one of several different materials, such as aluminum, stainless steel, or plastic. Another possible variation would be latch systems employing more than one latch to secure the legs of a telescoping ladder. And yet another variation could employ a latch having a bent portion that is curved instead of straight.

Thus, the scope of this invention should be determined by the following claims and their legal equivalents, rather than by the specifications and examples given.

What is claimed is:

1. A ladder latching system for telescoping ladders comprising:

a group of ladder legs comprising an innermost telescoping ladder leg, an outermost telescoping ladder leg, and a plurality of telescoping ladder legs in between said innermost telescoping ladder leg and said outermost telescoping ladder leg, a catch at the end of said innermost telescoping ladder leg, a ladder-mounting bracket having an oblong aperture and a narrow, oblong hole, a stop arm projecting from the side of said outermost telescoping ladder leg, said stop arm occupying said oblong aperture in said ladder-mounting bracket, said stop arm having the ability to slide back and forth in said oblong aperture in said ladder-mounting bracket, a latching device, said latching device being mounted to said ladder-mounting bracket over said narrow, oblong hole and in front of end of said innermost telescoping ladder leg having said catch, means, including a plurality of nuts and screws, for mounting said latching device to said ladder-mounting bracket, latch release means in end of said innermost telescoping ladder leg opposite end having said catch, including a knob, a spring, and a rod, for releasing said latching device, a portion of said knob extending from said end of said innermost telescoping ladder leg opposite end having said catch, means for securing said latch release means to said innermost telescoping ladder leg comprising a pin running through an oblong groove in said knob and intersecting said innermost telescoping ladder leg with both its ends, means responsive to movement of said ladder-mounting bracket for pushing said latching device towards said catch on said innermost telescoping ladder leg, means responsive to movement of said group of ladder legs for pushing said catch on said innermost telescoping ladder leg towards said latching device, said latching device contacting said catch, said latching device clasping and securing said catch on said innermost telescoping ladder leg, means responsive to movement of said knob for activating said latch release means, said latch release means releasing said latching device.

2. The ladder latching system for telescoping ladders of claim 1, wherein said group of ladder legs is made of stainless steel.

3. The ladder latching system for telescoping ladders of claim 1, wherein said catch at the end of said innermost telescoping ladder leg is made of stainless steel.

4. The ladder latching system for telescoping ladders of claim 3, wherein said catch at the end of said innermost telescoping ladder leg that is made of stainless steel is semi-circular in shape.

5. The ladder latching system for telescoping ladders of claim 1, wherein said stop arm is made of stainless steel.

6. The ladder latching system for telescoping ladders of claim 5, wherein said stop arm that is made of stainless steel is cylindrical in shape.

7. The ladder latching system for telescoping ladders of claim 1, wherein said latch release means consists of the following, in combination:

a rod running through interior of said innermost telescoping ladder leg, said rod connected to the end portion of said knob opposite end portion of said knob protruding from end of said innermost telescoping ladder leg that is opposite end of said innermost telescoping ladder leg having said catch;

a spring in said oblong groove of said knob between said pin and said end portion of said knob extending from end of said innermost telescoping ladder leg opposite end of innermost telescoping ladder leg having said catch.

8. A ladder latching system for telescoping ladders comprising, in combination, the following:

a ladder-mounting bracket formed from a flat piece of material bent along a straight line into two portions that are perpendicular to each other, one portion of said ladder-mounting bracket having an oblong hole and a small, narrow hole in front of said oblong hole, a group of telescoping ladder legs attached to a stop arm, an innermost telescoping ladder leg encompassed by said group of telescoping ladder legs, said stop arm occupying said oblong hole in portion of said ladder-mounting bracket having said oblong hole and said small, narrow hole, a catch comprised of a plate of metal forming a half circle over end opening of said innermost telescoping ladder leg that is closest to said small, narrow hole on portion of said ladder-mounting bracket having said oblong hole;

a knob in the end of said innermost telescoping ladder leg opposite end having said catch, a portion of said knob protruding out of end of said innermost telescoping ladder leg opposite end having said catch, an elongated, open groove in said knob running parallel to said knob's axis and opening on opposite ends of said knob's diameter along said knob's length, a pin running parallel to the diameter of said knob through said elongated, open groove in said knob, means, including said pin intersecting said innermost telescoping ladder leg with both its ends, for anchoring said knob to said innermost telescoping ladder leg, a spring in said elongated, open groove of said knob between said pin and portion of said knob protruding out of end of said innermost telescoping ladder leg opposite end having said catch;

a rod projecting from end of said knob opposite portion of said knob protruding out of end of said telescoping ladder leg opposite end having said catch, said rod extending through interior of said innermost telescoping ladder leg;

a latch having a straight segment and a bent segment, a plurality of holes in said straight segment of said latch, a spacer having a groove along its center, a plurality of holes in said groove in said spacer;

said straight segment of said latch occupying said groove in said spacer, said plurality of holes in said straight segment of said latch aligning with said plurality of holes in said groove in said spacer;

said spacer and said latch being placed over said small, narrow hole on side of said ladder-mounting bracket having said group of telescoping ladder legs and said innermost telescoping ladder leg, said latch and said spacer being placed over said small, narrow hole in front of said group of telescoping ladder legs and said innermost telescoping ladder leg with side of said spacer having said horizontal groove facing away from side of said ladder-mounting bracket, said holes in said straight segment of said latch and said holes in said groove of said spacer aligning with said small, narrow hole in said ladder-mounting bracket;

means, including a plurality of nuts and screws, for fastening said spacer and said latch to said ladder-mounting bracket over said small, narrow hole;

said bent segment of said latch occupying plane on side of said straight segment of latch facing away from side of said ladder-mounting bracket;

means for engaging said latch comprising a force means exerted on said innermost telescoping ladder leg pushing said innermost telescoping ladder leg and said catch at end of said innermost telescoping ladder leg towards said bent segment of said latch and, said catch contacting and depressing said bent segment of said latch and, said catch sliding over and past said bent segment of said latch and, said bent segment of said latch snapping back into former position behind said catch;

means for disengaging said latch comprising a force exerted on said knob pushing down said knob, said knob pushing forward and compressing said spring and, said rod connected to said knob moving forward against said bent segment of said latch and, said bent segment of said latch being depressed clear of said catch and, a pulling force means exerted on said group of telescoping ladder legs and said innermost telescoping ladder leg pulling said catch clear of said bent segment of said latch and, said spring expanding back to former length and returning said knob and said rod to previous positions.

9. The ladder latching system for telescoping ladders of claim 8, wherein said latch is made of stainless steel.

10. The ladder latching system for telescoping ladders of claim 9, wherein said latch that is made of stainless steel is rectangular in shape.

11. The ladder latching system for telescoping ladders of claim 8, wherein said spacer is made of plastic.

12. The ladder latching system for telescoping ladders of claim 11, wherein said spacer that is made of plastic is square in shape.

13. The ladder latching system for telescoping ladders of claim 8, wherein said knob is made of plastic.

14. A ladder latching system for telescoping ladders comprising the following, in combination:

a ladder-mounting bracket comprising a flat piece of material bent along a line into one wide plane and one narrow plane that are perpendicular to each other;

a long, narrow aperture and a short, narrow hole in said wide plane of said ladder-mounting bracket;

a group of ladder legs comprising an innermost telescoping ladder leg, an outermost telescoping ladder leg, and a plurality of telescoping ladder legs in between;

a stop arm extending from side of said outermost telescoping ladder leg;

said stop arm moving slidably in said long, narrow aperture in said wide plane of said ladder-mounting bracket;

a catch at the end of said innermost telescoping ladder leg;

a latching device mounted over said short, narrow hole in said wide plane of said ladder-mounting bracket;

a latch releasing device in the end of said innermost telescoping ladder leg opposite end having said catch;

means, including a pin, for securing said latch releasing device to said end of innermost telescoping ladder leg opposite end having said catch.

15. The ladder latching system of claim 14, wherein said ladder-mounting bracket is made of stainless steel.

16. The ladder latching system of claim 14, wherein said group of ladder legs is made of stainless steel.

17. The ladder latching system of claim 14, wherein said stop arm is made of stainless steel.

18. The ladder latching system of claim of claim 17, wherein said stop arm that is made of stainless steel is cylindrical in shape.

19. The ladder latching system of claim 14, wherein said catch is made of stainless steel.

20. The ladder latching system of claim 19, wherein said catch that is made of stainless steel is semi-circular in shape.

21. A ladder latching system for telescoping ladders comprising the following, in combination:

a ladder-mounting bracket, a long, oblong aperture in said ladder-mounting bracket, a small, narrow hole in said ladder-mounting bracket, a plurality of telescoping ladder legs, an innermost telescoping ladder leg encompassed by said plurality of telescoping ladder legs, an outermost telescoping ladder leg encompassing said plurality of telescoping ladder legs and said innermost telescoping ladder leg, a stop arm projecting from the side of said outermost telescoping ladder leg moving slidably in said long, oblong aperture in said ladder-mounting bracket, a latching mechanism on the side of said ladder-mounting bracket over said small, narrow hole, means, including a plurality of nuts and screws, for mounting said latching mechanism to side of said ladder-mounting bracket, a catch on the end of said innermost telescoping ladder leg, a latch-release mechanism in end of said innermost telescoping ladder leg opposite end having said catch, means, including a pin, for anchoring said latch-release mechanism to end of said innermost telescoping ladder leg opposite end having said catch.

22. The ladder latching system of claim 21, wherein said ladder-mounting bracket is made of stainless steel.

23. The ladder latching system of claim 21, wherein said plurality of telescoping ladder legs are made of stainless steel.

24. The ladder latching system of claim 21, wherein said stop arm is made of stainless steel.

25. The ladder latching system of claim 24, wherein said stop arm that is made of stainless steel is cylindrical in shape.

26. A ladder latching system for telescoping ladders comprising, in combination, the following:

a ladder-mounting bracket, an oblong aperture in said ladder-mounting bracket, a small, narrow hole in said ladder-mounting bracket, a plurality of telescoping ladder legs, an innermost telescoping ladder leg encompassed by said plurality of telescoping ladder legs, an outermost telescoping ladder leg encompassing said plurality of telescoping ladder legs and said innermost telescoping ladder leg, a stop arm projecting from the side of said outermost telescoping ladder leg, latching means, including a latch and a spacer, on the side of said ladder-mounting bracket over said small, narrow hole, means, including a plurality of screws and nuts, for fastening said latching means to a side of said ladder-mounting bracket over said small, narrow hole, a catch on the end of said innermost telescoping leg, latch-releasing means, including a spring, a rod, and a knob, in the end of said innermost telescoping ladder leg opposite end having said catch, means, including a pin, for anchoring said latch-release means to end of said innermost telescoping ladder leg opposite end having said catch.

27. The ladder latching system of claim 26, wherein said plurality of telescoping ladder legs are made of stainless steel.

28. The ladder latching system of claim 26, wherein said stop arm is cylindrical in shape.

29. The ladder latching system of claim 28, wherein said stop arm that is cylindrical in shape moves slidably in said oblong aperture in side of said ladder-mounting bracket.

30. The ladder latching system of claim 26, wherein said latch has a bent segment and a straight segment.

31. The ladder latching system of claim 30, wherein said latch that has a bent segment and a straight segment is made of stainless steel.

32. The ladder latching system of claim 26, wherein said spacer is made of plastic.

33. The ladder latching system of claim 32, wherein said spacer that is made of plastic is square in shape.

34. The ladder latching system of claim 26, wherein said catch is made of stainless steel.

35. The ladder latching system of claim 26, wherein said spring is made of stainless spring steel.

36. The ladder latching system of claim 22, wherein said rod is made of stainless steel.

37. The ladder latching system of claim 36, wherein said rod that is made of stainless steel is cylindrical in shape.

38. The ladder latching system of claim 26, wherein said knob is made of plastic.

* * * * *